US007284943B2

(12) United States Patent
Pruteanu et al.

(10) Patent No.: US 7,284,943 B2
(45) Date of Patent: Oct. 23, 2007

(54) FULL EJECT MANUAL/AUTOMATED SIDE LOADER

(75) Inventors: Claudiu D. Pruteanu, Kasson, MN (US); John G. Pecka, Dodge Center, MN (US)

(73) Assignee: McNeilus Truck and Manufacturing, Inc., Dodge Center, MN (US)

( * ) Notice: Subject to any disclaimer, the term of this patent is extended or adjusted under 35 U.S.C. 154(b) by 354 days.

(21) Appl. No.: 11/041,769

(22) Filed: Jan. 24, 2005

(65) Prior Publication Data

US 2005/0135910 A1 Jun. 23, 2005

Related U.S. Application Data

(63) Continuation-in-part of application No. 10/414,659, filed on Apr. 16, 2003, now Pat. No. 7,070,382.

(51) Int. Cl.
*B65F 3/14* (2006.01)

(52) U.S. Cl. ..... 414/525.2; 414/812

(58) Field of Classification Search ..... 414/406, 414/409, 521, 525.2, 525.51, 525.52, 525.55, 414/810, 812

See application file for complete search history.

(56) References Cited

U.S. PATENT DOCUMENTS

| | | | | |
|---|---|---|---|---|
| 2,487,411 | A | 11/1949 | Balbi | |
| 3,765,554 | A | 10/1973 | Morrison | |
| 3,815,765 | A | 6/1974 | Moser et al. | |
| 3,905,497 | A | 9/1975 | Stedman et al. | |
| 3,921,839 | A | 11/1975 | Herpich | |
| 4,096,956 | A | 6/1978 | Gaskin | |
| 4,221,527 | A | 9/1980 | Morrison | |
| 4,260,316 | A | 4/1981 | Gollnick | |
| 4,316,695 | A | 2/1982 | Knight, Sr. | |
| 4,892,454 | A | 1/1990 | Behling et al. | |
| 4,992,019 | A * | 2/1991 | Behling et al. | 414/525.2 |
| 5,651,654 | A | 7/1997 | Christenson | |
| 5,769,592 | A | 6/1998 | Christenson | |
| 5,857,822 | A | 1/1999 | Christenson | |
| 5,931,628 | A | 8/1999 | Christenson | |
| 6,332,745 | B1 | 12/2001 | Duell et al. | |
| 6,435,802 | B1 | 8/2002 | Schreiber et al. | |
| 7,070,382 | B2 * | 7/2006 | Pruteanu et al. | 414/525.2 |

FOREIGN PATENT DOCUMENTS

| | | |
|---|---|---|
| FR | 1502834 | 10/1967 |

* cited by examiner

*Primary Examiner*—Charles A Fox
(74) *Attorney, Agent, or Firm*—Nikolai & Mersereau, P.A.; C. G. Mersereau

(57) ABSTRACT

A manual/automatic side loading and rear discharge refuse collection truck body as disclosed which incorporates full ejection without truck body tipping. A unique packing system as provided which includes a low profile packer panel which operates in a low profile charging material receiving hopper which also features lowered or dropped floor to facilitate optional manual loading. The charging hopper features a low profile which creates a dropped area beneath the forward portion of the storage enclosure so that material deposited in the charging hopper can be fed by the packing system into the storage enclosure through a bottom forward charging opening. A packer-ejector assist panel is provided to assist in clearing material from the dropped area portion of the charging hopper.

15 Claims, 18 Drawing Sheets

FULL EJECT MANUAL/AUTOMATED SIDE LOADER

This application is a continuation-in-part of application Ser. No. 10/414,659, filed Apr. 16, 2003, now U.S. Pat. No. 7,070,382 the entirety of which is hereby incorporated by reference herein.

BACKGROUND OF THE INVENTION

I. Field of the Invention

The present invention relates generally to refuse vehicles, particularly to dedicated side-loading, rear discharging refuse vehicle bodies capable of both manual and automated loading. More particularly, the invention relates to such vehicle bodies incorporating new compacting and ejecting mechanisms. The ejector provides full ejection of the packed contents of the body without the need for tipping the truck body as refuse is discharged. A charging hopper is provided having a floor and sidewalls lowered to facilitate manual loading in addition to optional automated loading using a mounted container handling mechanism. A low profile reciprocating packer panel moves refuse from the lowered or "dropped area" of the receiving hopper into a vehicle body storage enclosure through a bottom opening accessed from the hopper dropped area. A vertically pivoting packer-ejector assist panel is provided to clear the dropped area during ejection and optionally assist packing if desired.

II. Related Art

Refuse hauling trucks commonly include a heavy-duty chassis and a hollow truck body mounted on the chassis dedicated to receiving, compacting, discharging refuse materials. This combination generally includes all the associated hydraulic, pneumatic and/or electrical operating mechanisms associated with heavy-duty packing and ejection equipment. In side loading system, the truck cab is located in front of the receiving hopper which charges a rear storage enclosure. Refuse to be hauled is loaded into the receiving hopper as by dumping containers either manually or using a mechanized container handling device mounted on the charging hopper or truck chassis. A packing device including a reciprocating or rotating ram, usually hydraulically operated, compacts the material moving it rearward into the storage compartment. Loading of the charging hopper is accomplished through side openings. The bottom or floor of the charging hopper typically is located at a height equal to or above that of the storage enclosure.

It is known to provide a front or side loading refuse vehicle with a packing and ejecting mechanism that packs refuse from a charging hopper into an associated hollow storage enclosure and later fully ejects the refuse from the storage enclosure. An example of such a refuse truck body system is shown in U.S. Pat. No. 5,857,822. It is also known to provide a side loading refuse vehicle having a recessed or dropped receiving hopper floor and chassis relative to a storage body floor to enable material receiving opening to start correspondingly closer to the ground to facilitate the manual loading of the receiving hopper. An example of this type truck body is illustrated and described in U.S. Pat. No. 5,931,628.

It is also known to provide a mechanized lifting and emptying apparatus situated on one side of the receiving hopper such that a container of interest may be engaged on that side and emptying through the material receiving opening into the receiving hopper. Such an apparatus typically includes a holding or grasping device generally connected to an arm or extensible boom which is connected, in turn, to a base mounted on the vehicle. The arm or boom and grasping device are operated in concert to engage the container of interest, lift and dump the container into the receiving hopper in the vehicle. Such systems are typically operated using one or more hydraulic devices to extend or retract the boom, pivot the arm and open and close the grabbing device. Examples of such booms are shown in U.S. Pat. Nos. 5,657,654, 5,769,592 and 5,931,628 (mentioned above).

While the prior devices of the related art have met with a certain amount of success, there remains a definite need for a mechanically simplified, lower maintenance full eject side loading refuse collection truck body that offers both manual and automated loading in which the packer is constructed in a manner which cannot interfere with the loading of refuse and which includes a full-eject ejection mechanism which allows full emptying of the storage chamber of the truck body without the need for tipping.

SUMMARY OF THE INVENTION

By means of the present invention, there is provided a side loading refuse collection vehicle body for loading, compacting, transporting and ejecting refuse materials. The truck body includes a hollow refuse storage enclosure for containing collected and compacted refuse that has a rear refuse discharge opening including a tailgate against which the refuse is packed and a forward bottom refuse receiving opening is provided which connects with a charging hopper disposed forward of the storage enclosure for receiving refuse from refuse containers which are tipped manually or using automated equipment. A mechanized container handling device may be optionally mounted on the charging hopper and used to lift and tip containers as depicted in the detailed embodiment. The floor portion of the truck body including the charging hopper and the area beneath the storage enclosure refuse receiving opening is lowered, as is the side access, so that manual loading is facilitated.

Deposited refuse is pushed back and up into the storage compartment by a low profile reciprocating packing ram mechanism. The reciprocating packing ram mechanism itself also includes a follower so that it is not possible to deposit refuse behind the packer even if the ram is in the full forward position.

The packing and ejection mechanisms include a packer-ejector assist panel or blade which pivots in a vertical plane to sweep refuse materials deposited in and pushed to the rear of the charging hopper in the dropped area by the packer panel from the charging hopper into the storage enclosure. This device is attached to the ejector panel and is designed to be operated in conjunction with the full-eject ejection mechanism to clear the dropped area, but, as indicated, may also be operated to assist in the packing operation. In a preferred embodiment, the packer-ejector assist panel is mounted on spaced in-line shafts journaled in fixed mounts carried by the full-eject ejector panel structure and which flank and are driven by a double-ended hydraulic motor which rotates the shafts to pivot the blade through an arc subtending an angle of about 270°. The packer-ejector assist panel extends laterally across the width of the charging hopper to provide a full sweep.

The system also includes a full-eject ejector mechanism that operates in the storage enclosure and which includes a transverse, generally vertical ejection panel operable along a path whose direction is parallel to the length of the refuse storage enclosure to provide complete ejection of the contents without the need for tipping the storage body during the ejection operation. The ejection mechanism is advantageously operated by a single telescoping linear device, preferably a telescoping double-acting hydraulic cylinder connected behind the panel for reciprocally operating the panel fore and aft during an ejection cycle.

When it is not in use, the vertically pivoting packer-ejector assist blade is pivoted up to a generally vertical posture and so it is completely out of the way of refuse being deposited and packed by the reciprocating mechanism. In an alternative embodiment, the packer-ejector assist panel is mounted in a manner that enables it to be lifted out of the way to facilitate the processing of certain large refuse materials, particularly recyclables, such as cartons fabricated of corrugated material.

The container manipulating and emptying system which can be mounted on the charging hopper preferably includes an offset, short radius lift and dump arm mechanism having a narrow profile with a grabber offset mounted from a laterally extendable boom device which gives the system the desired lateral range in accessing containers of interest. The offset and arm construction further reduce the tipping radius and tipping height to facilitate addressing the low profile hopper opening of a manual/automated side loading refuse vehicle and the system, when not in use (stowed), presents a narrow profile which does not extend or protrude laterally beyond the width of the rest of the vehicle.

BRIEF DESCRIPTION OF THE DRAWINGS

In the drawings wherein like numerals depict like parts throughout the same.

DETAILED DESCRIPTION

The present invention incorporates full ejection without truck body tipping, together with optional manual/automatic side loading and rear discharge in a refuse collection truck body. A unique packing system is provided which includes a low profile packer panel which operates in a low profile charging or material receiving hopper which also features a lowered or dropped floor to facilitate optional manual loading. An associated hollow storage chamber enclosure is located behind the charging hopper which, in combination with the low profile, dropped floor charging hopper creates a dropped area beneath the forward portion of the storage enclosure so that material deposited in the charging hopper can be fed by the packing system into the storage enclosure through a bottom forward charging opening and thereafter be pushed and packed against a heavy rear tailgate discharge door.

A packer-ejector assist panel is provided to assist in clearing material from the dropped portion of the charging hopper located beneath the storage chamber or dropped area. The packer-ejector assist panel is in the form of a vertically pivoting blade which moves with a generally vertical ejector blade which travels the entire length of the storage enclosure during the ejection operation.

The embodiments illustrated and described in the specification are intended by way of example only and are not intended to limit the scope of the inventive concepts in any way. The features of the invention may be manifested in a variety of forms within the confines of the scope of the contemplated invention.

Figure 1:
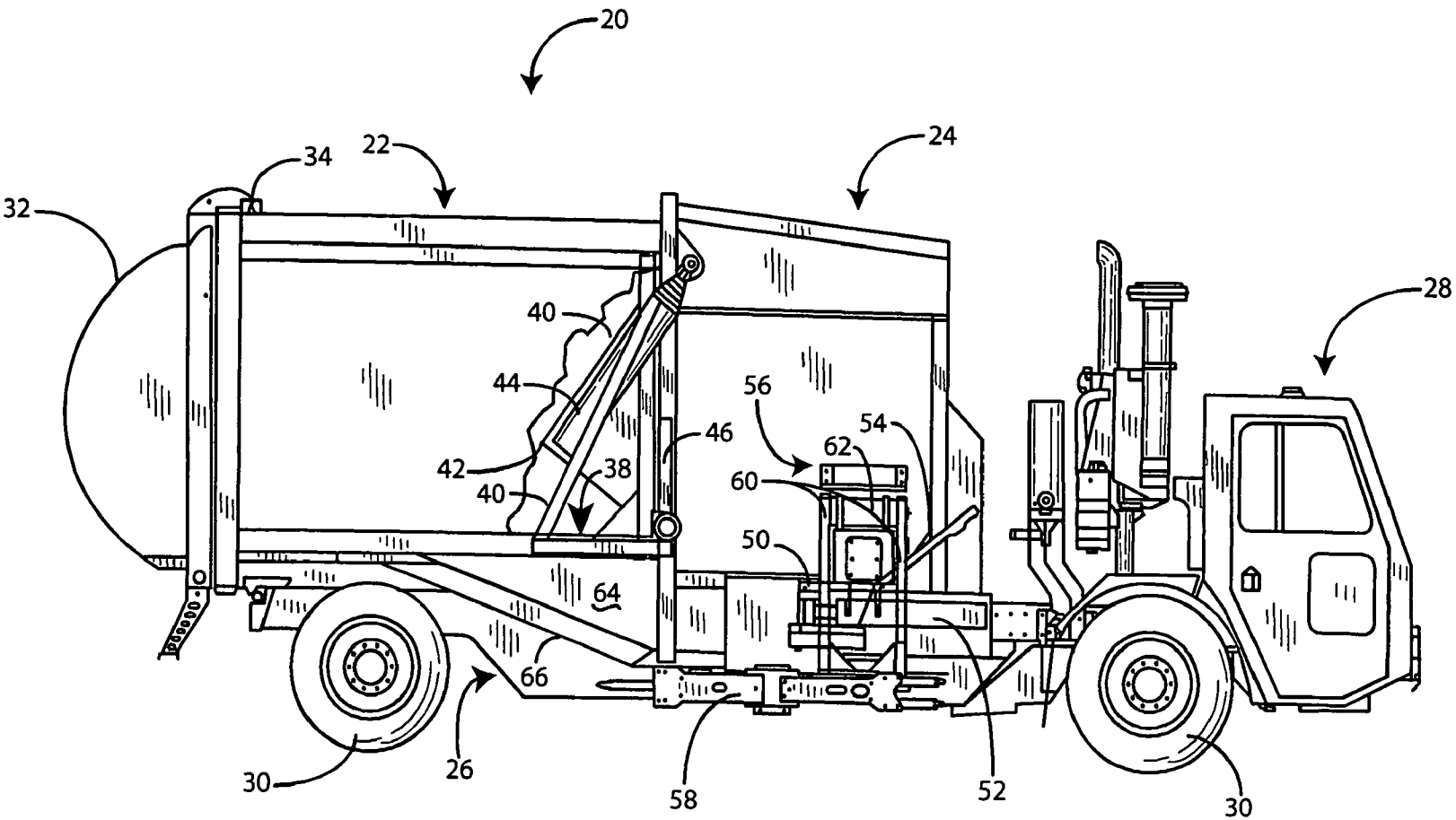
FIG. 1 is a side elevational view of a side loading refuse collection vehicle with internal parts exposed incorporating one preferred embodiment of the present invention depicted at the beginning (or end) of a packing cycle with the rotating packer-ejector assist panel and the packer panel in fully retracted positions.
Figure 2:
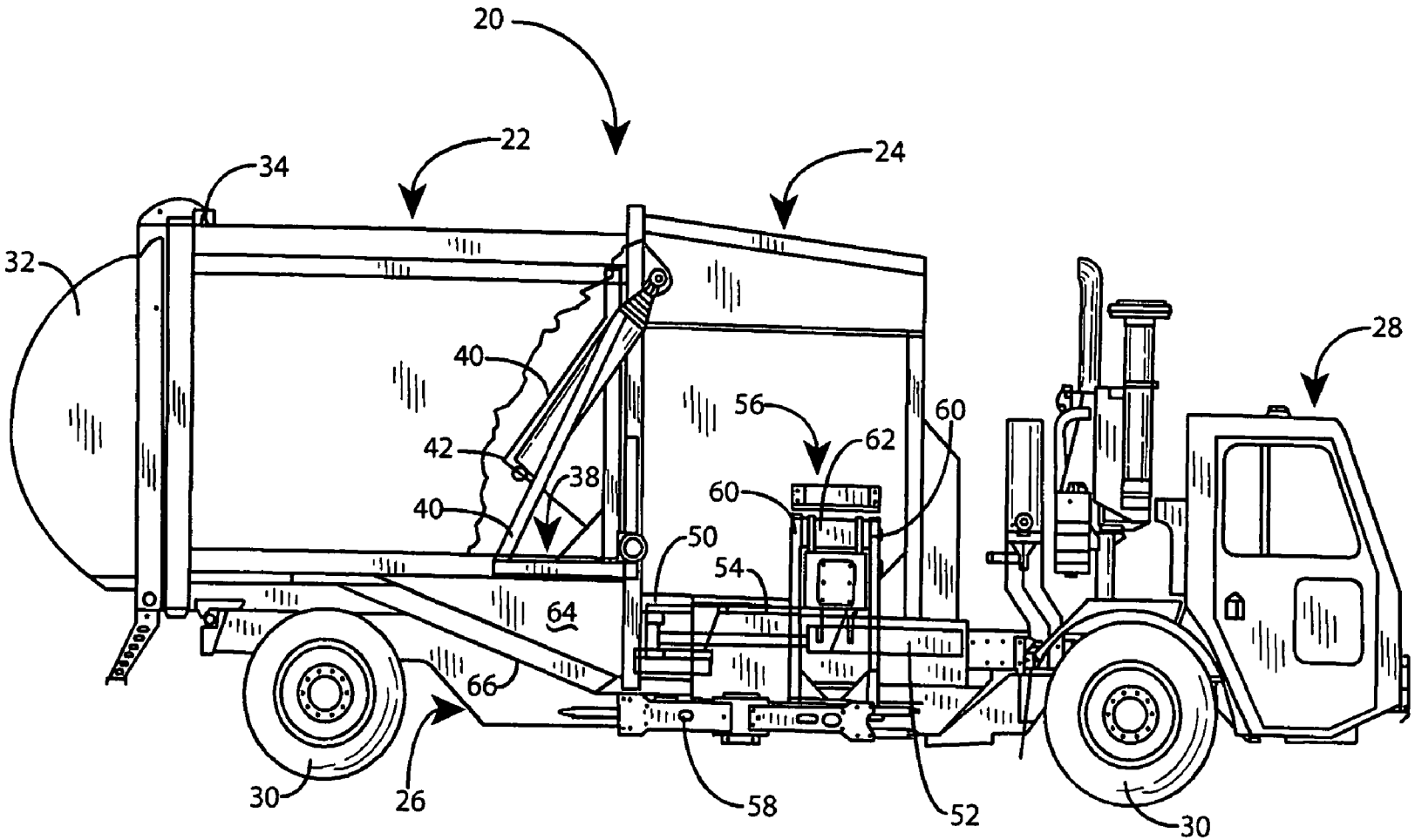
FIG. 2 is a view similar to FIG. 1 showing the packer panel in the advanced or packing position.

Given the above, FIGS. 1 and 2 depict a side loading refuse truck illustrating successive stages of refuse collecting or loading and FIGS. 3-6 depict such a vehicle in several stages of an ejection cycle. The refuse truck, generally at 20, includes a large hollow refuse storage enclosure 22 having a floor 23 that is flat or planer. The storage enclosure 22 is connected to or integral with a receiving or charging hopper 24, both of which are mounted on a heavy duty truck chassis 26 which also carries a conventional cab 28 and is mounted on wheels 30 in a conventional manner. The storage enclosure 22 is provided with a full size rear discharge opening closed by a heavy tailgate 32 which pivots vertically from a pair of top hinges, one of which is shown at 34. The tailgate is typically opened by a pair of hydraulic cylinders, one of which is shown at 36. The tailgate 32 is in the shape of a heavy duty pressure vessel member and refuse compacted into the storage enclosure 22 is pushed up against the tailgate when compacted so that it must withstand full compaction pressure. The refuse storage enclosure further includes a forward bottom refuse receiving opening 38 which extends across the full width of the storage enclosure and a full width, generally vertical, ejector panel 40 which has a protruding nose as at 42 which is adapted to receive the cylinder end of a large telescoping, double-acting hydraulic cylinder 44 which operates the packer panel 40 fore and aft along in the enclosure 22.

Attached to the rear portion of the ejector panel 40 is a pivotally mounted packer-ejector assist panel 46 which, together with the details of the mounting of the telescoping cylinder 44, are depicted in the front storage enclosure elevational view of FIG. 7, as will be discussed.

The charging hopper also includes a packer ram or packer panel 50 operated by a pair of double-acting hydraulic cylinders, one of which is shown at 52, and which includes a follower system depicted at 54 to prevent material from being deposited behind the packer 50. An optional automated loader arm or container emptying system is shown generally at 56 mounted on the forward portion of the charging hopper which includes an offset grabber system at 58 and includes an extensible boom (not shown) to give the system an extended lateral reach. Container emptying system 56 features the grabber assembly 58 mounted from the free ends of spaced parallel arm members 60, the fixed ends being connected to the opposite output ends of a double-ended hydraulic rotary actuator 62 which directly carries the arm assembly and reversibly rotates the assembly in a vertical plane at actuator 62 in the illustrated embodiment. One possible embodiment of such a system is illustrated and described in greater detail in co-pending application Ser. No. 09/844,843, entitled "AUTOMATED LOADER ARM", assigned to the same assignee as the present invention, the entire contents of which is hereby incorporated by reference for any purpose.

Figure 8:
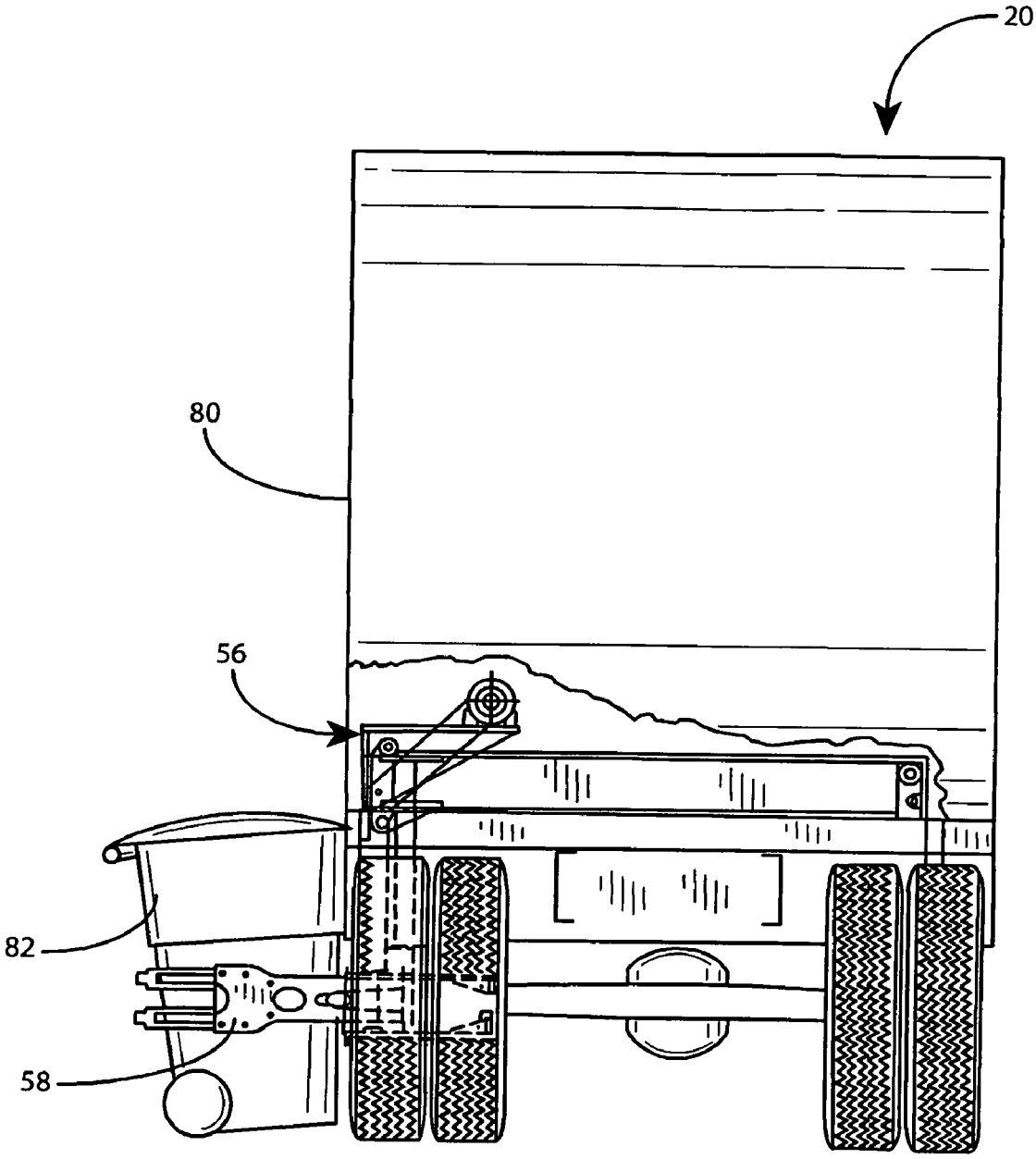
FIG. 8 is a rear view of the refuse vehicle of FIG. 1 showing the profile of the container lift and dump mechanism in a retracted position.

The chassis 26 is built in a lowered configuration to accommodate the lowered charging hopper and dropped area 64 beneath the opening 38 in the storage enclosure 22 as evidenced by chassis structural member 66. Note that the side rim 68 in the charging hopper 24 is at or below the level of the floor 70 of the storage enclosure 22 to enable easy manual loading over the grabber device 58 when it is retracted. As can be seen in the rear elevational view of the vehicle in FIG. 8, the container emptying system 56 has a narrow profile such that when it is in the retracted position, it does not protrude beyond the edge of the vehicle as designated by reference line 80 in FIG. 8. A grabbed container is shown at 82, however, the grabber, when retracted, is within line 80.

Figure 7:
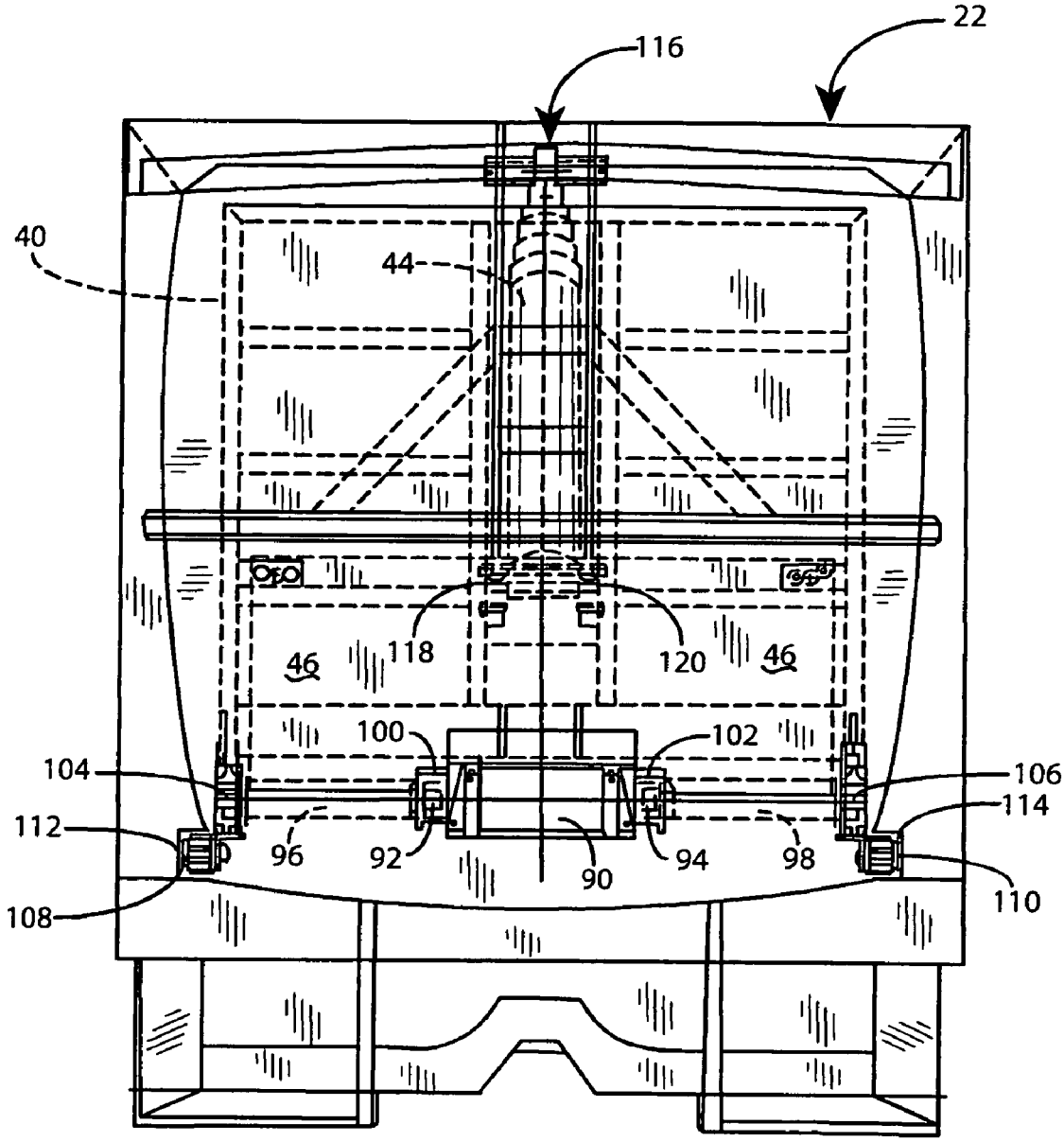
FIG. 7 is a front elevational view from the charging hopper of a refuse storage enclosure as in FIGS. 1-6 showing the mounting of the packer-ejector assist panel and linear ejector blade operator.

FIG. 7 shows more detail with respect to the packer-ejector assist panel 46 including a hydraulic rotary motor 90 having dual output shafts 92 and 94, respectively, connected to spaced aligned panel carrying shafts 96 and 98 as by connections 100 and 102. Shafts 96 and 98 are respectfully journaled in bearing mounts 104 and 106. The ejector panel 40 is further supported by one or more pairs of spaced wear shoes as at 108 and 110 which ride in corresponding rails at 112 and 114 as the packer panel reciprocates along the length of storage enclosure 22. The telescoping cylinder 44 is further pivot mounted including a top pivot mount 116 and lower pivot mounts 118 and 120 as further shown in the detail of FIG. 7.

Beginning with the view of FIG. 1, the operating sequence of the system will be described. FIG. 1 shows the side loading refuse vehicle of the invention with both the packer ram 50 and the packer-ejector assist blade 46 in their fully retracted or stowed positions with the tailgate 32 closed and the ejector panel 40 in the fully retracted position ready to receive material into the charging hopper 24, either by using the container handling system 56 or manually. In FIG. 2, material has been added to the charging hopper 24 and the packing ram 50 is shown in the fully forward packing position as used to urge refuse out of the charging hopper 24 into the dropped area 64 from which it is forced up into the storage enclosure 22. This continues until the storage enclosure chamber 22 is entirely full with refuse being packed up against the tailgate 32 at which time it is necessary to eject the garbage from the storage area, normally at a landfill.

Figure 3:
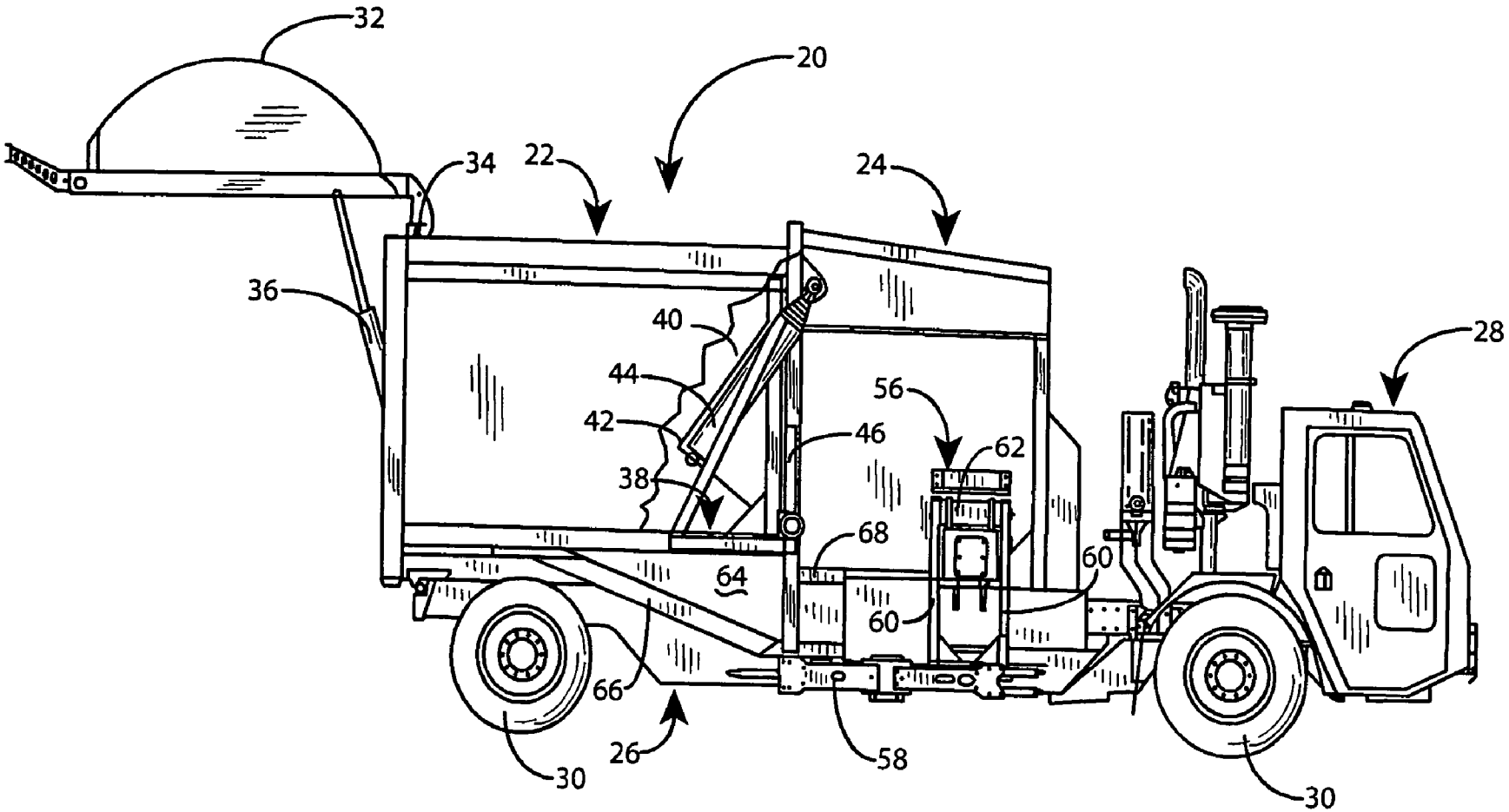
FIG. 3 is a view similar to FIGS. 1 and 2 showing the system at the beginning of an ejection cycle with the tailgate raised and the packer mechanism removed for clarity.
Figure 4:
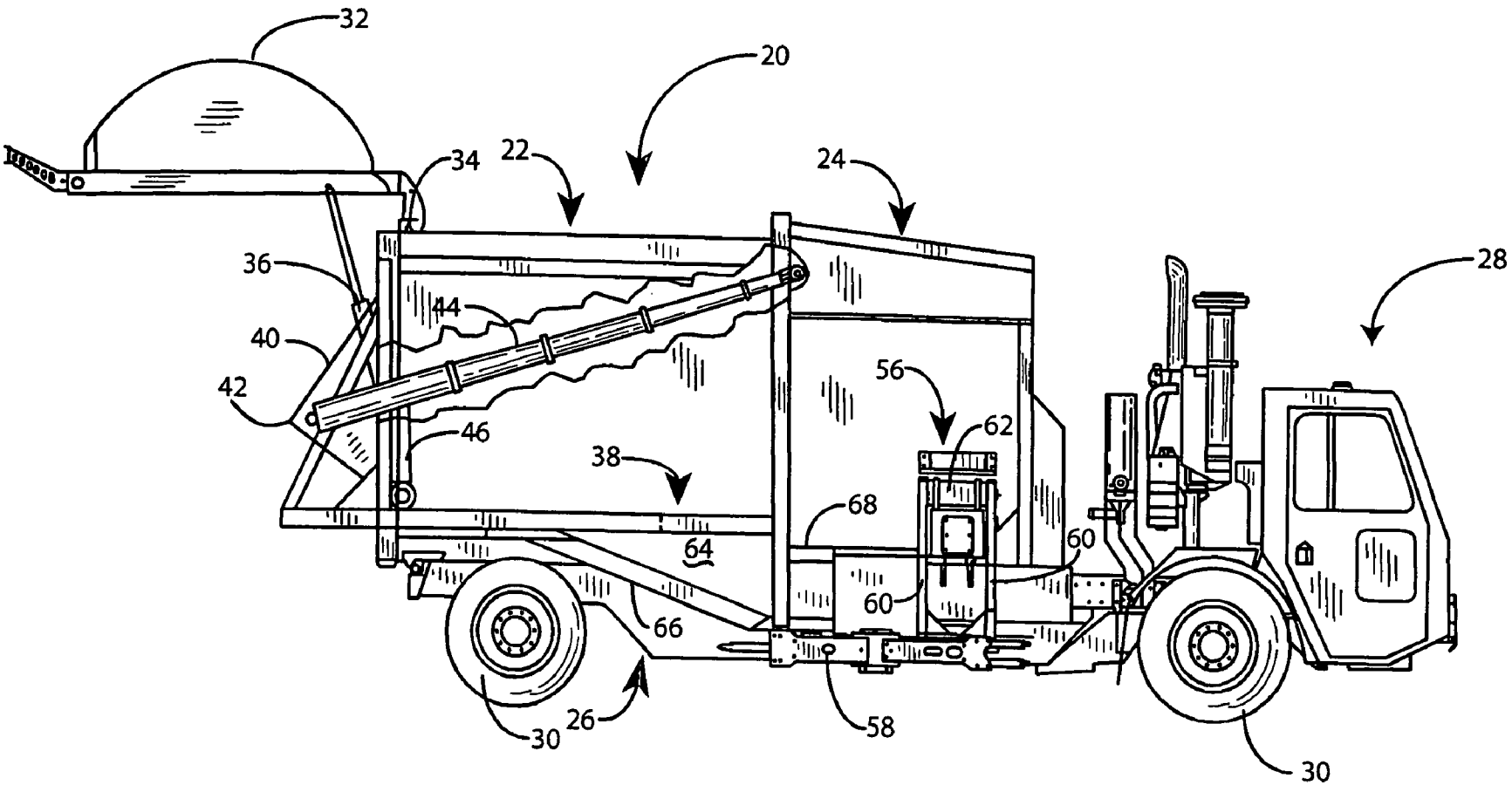
FIG. 4 is a view similar to FIG. 3 showing the system at full eject in an initial load pushout stroke in an ejection sequence.
Figure 5:
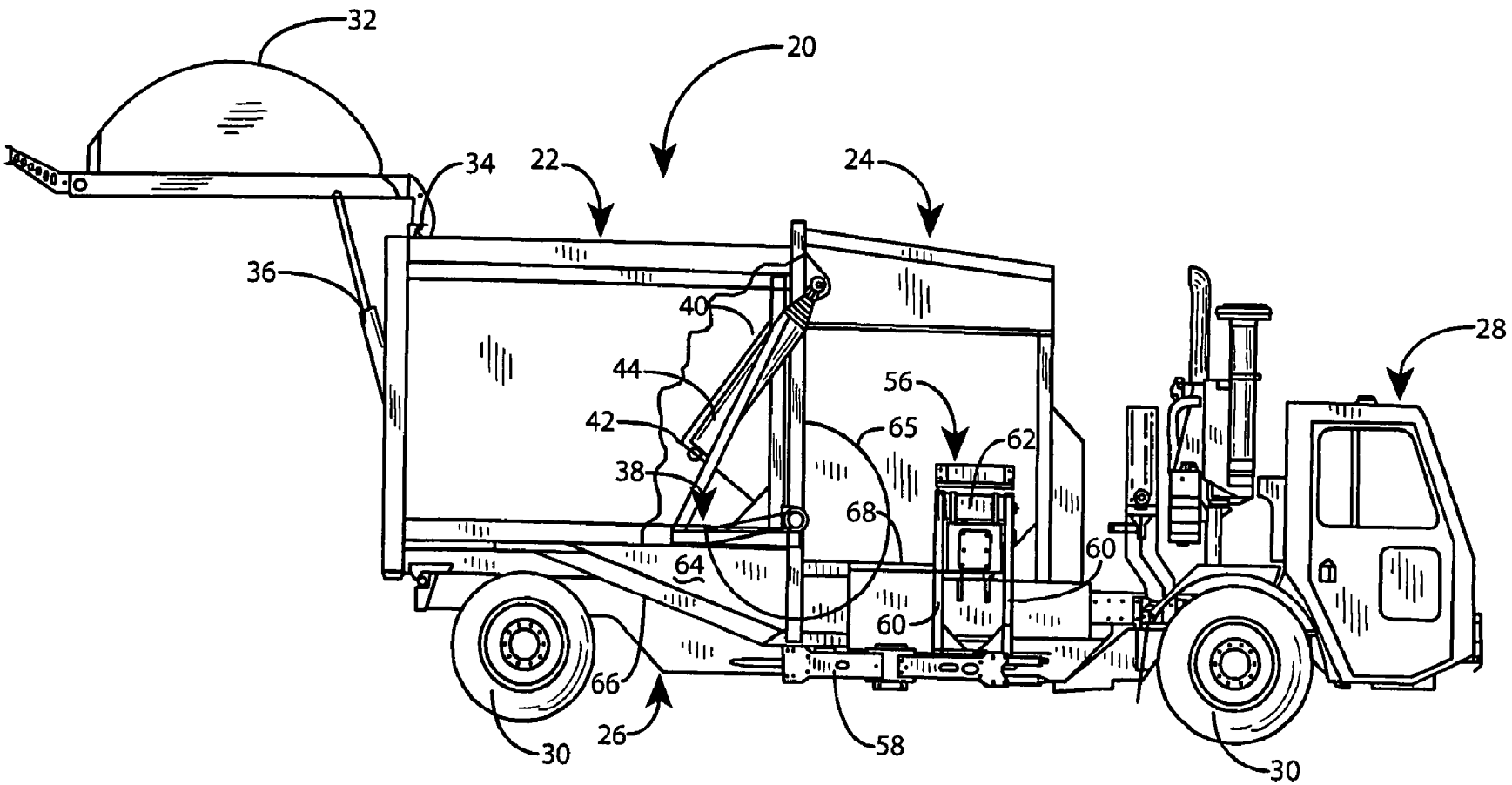
FIG. 5 is a view similar to FIG. 3 with the ejector fully retracted and the packer-ejector assist panel fully rotated to sweep clean the dropped area.
Figure 6:
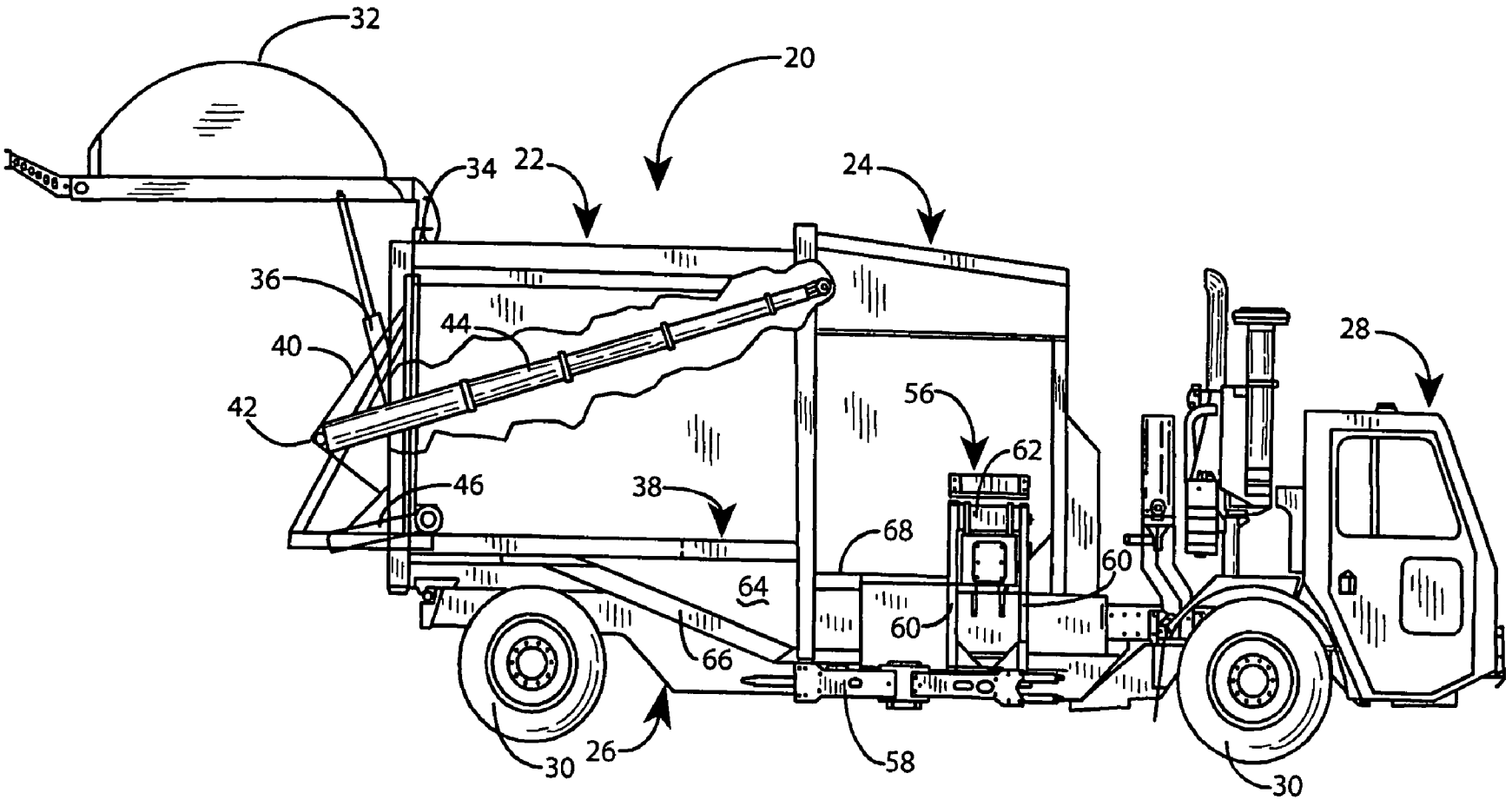
FIG. 6 is a view similar to FIG. 4 showing the system in a second full-eject power stroke position of the ejection cycle with the packer-ejector assist panel fully rotated to eject material from the dropped area.

Steps in the ejection cycle are shown in FIGS. 3-6. In FIG. 3, the system is shown with both the packing ram and the packer-ejector assist panel 46 in the fully retracted positions as is the ejector panel 40, the tailgate 32 having been unlatched and raised in preparation for ejection. In FIG. 4, the ejector panel 40 is shown in the complete rearward or full eject position having pushed all the materials within the confines of the storage enclosure 22 out of that chamber. This completely ejects the material collected by the vehicle except for a minor amount of material remaining in the dropped area 64. FIG. 5 depicts the ejection panel 40 after it has been fully retracted following the initial full ejection stroke and the packer-ejector assist panel has been fully rotated describing an arc shown at 65 to push the material remaining in the dropped area 64 ahead of it as it is rotated to provide substantial closure of the storage enclosure charging opening 38. Finally, as shown in FIG. 6, the second full-eject stroke is performed with the packer-ejector assist panel remaining in the fully rotated position so that material scooped from the dropped area is also ejected. It should be noted that the step of pivoting the packer-ejector panel can be carried out during the packing operation between strokes of the packer ram, if desired, to assist in the packing operation.

Figure 9:
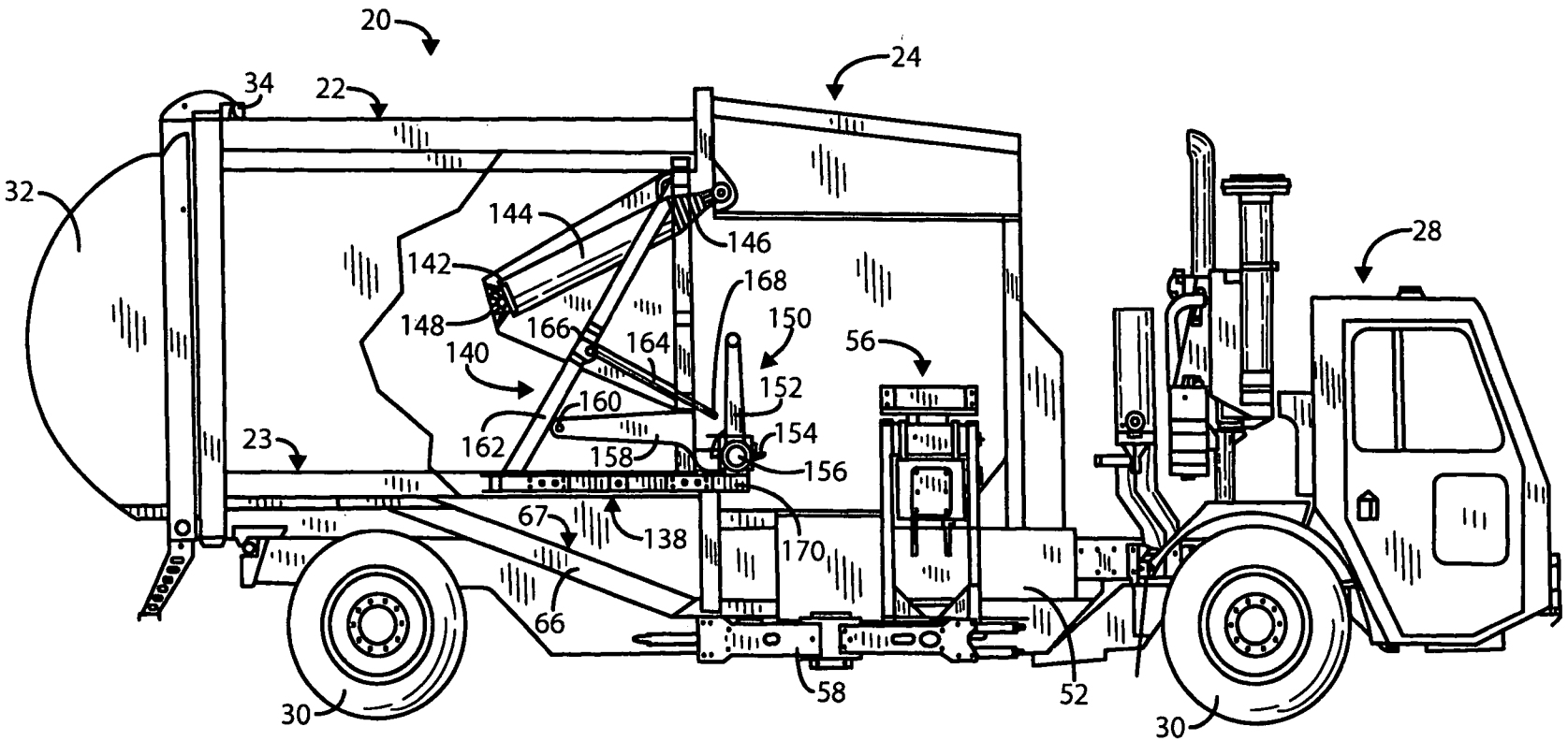
FIG. 9 is a view similar to that shown in FIG. 1 featuring an alternative embodiment includes a modified packing and ejection system with an alternate packer-ejector assist panel assembly.

FIGS. 9-18 depict an alternative embodiment of the collection system of FIGS. 1-8 which features an alternate embodiment of a packing and ejection mechanism assembly for a side loading, dropped bottom refuse body. The alternate embodiment features a packer-ejector assist panel mechanism that enables the panel to be raised to better clear and improve the handling of certain types of packed material, particularly recyclable materials such as corrugated carton or cardboard materials which may have a potential or tendency to jam in low clearance systems. Thus, FIG. 9 is a view similar to that shown in FIG. 1 but featuring a modified packing and ejection system including an alternate packer-ejector assist panel mechanism, generally at 150. The refuse storage enclosure 22 includes a forward bottom refuse receiving opening indicated by 138 which extends across the full width of the charging hopper and storage enclosure and a full width, generally vertical ejector panel 140 which has a protruding nose as at 142 and which is adapted to receive the cylinder end 148 of a large multi-segment telescoping, double-acting hydraulic cylinder 144 which operates the packer panel reciprocally fore and aft along the enclosure 22. The cylinder 144 has a rod or piston end 146 mounted in fixed relation to the front of the refuse storage enclosure 22 and barrel or cylinder end 148 fixed to the nose portion 142 of the ejector system 140.

Figure 11:
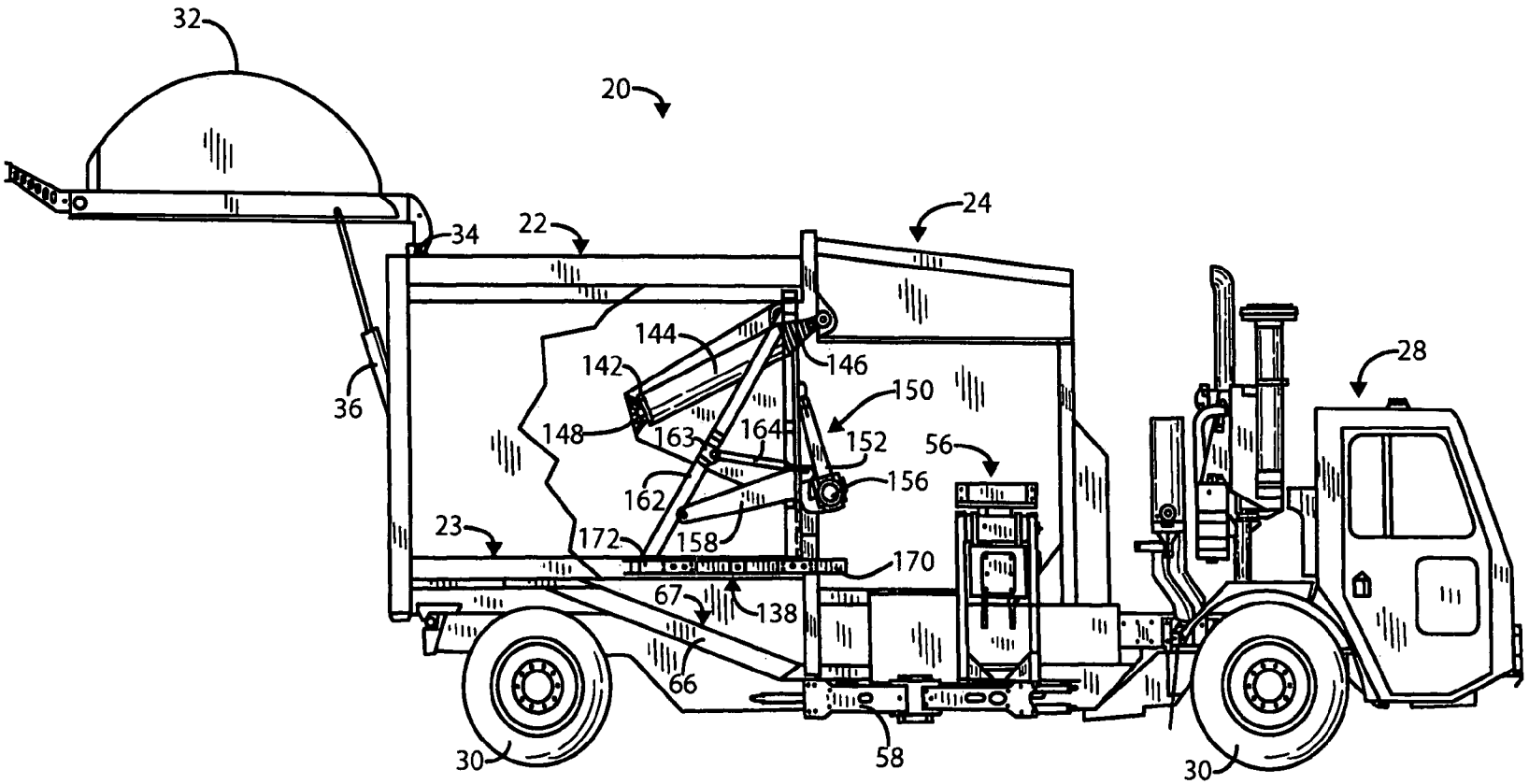
FIG. 11 is a view similar to FIG. 10 with the packer-ejector assist panel assembly shown with the packer-ejector assist panel in a raised position prior to an initial ejection stroke.
Figure 12:
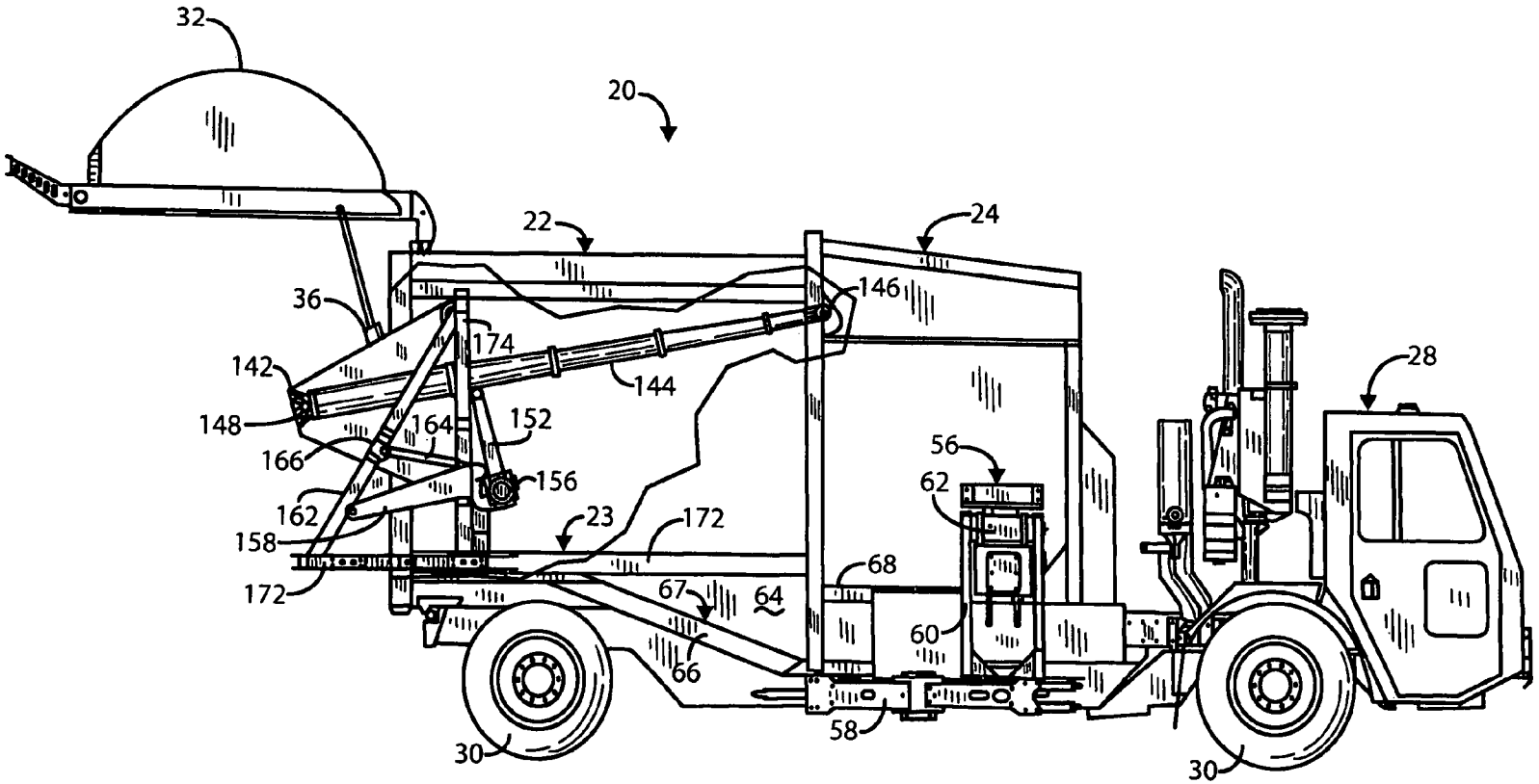
FIG. 12 is a view similar to FIG. 4 with the system depicted at full eject in an initial load pushout stroke of an ejection sequence.
Figure 14:
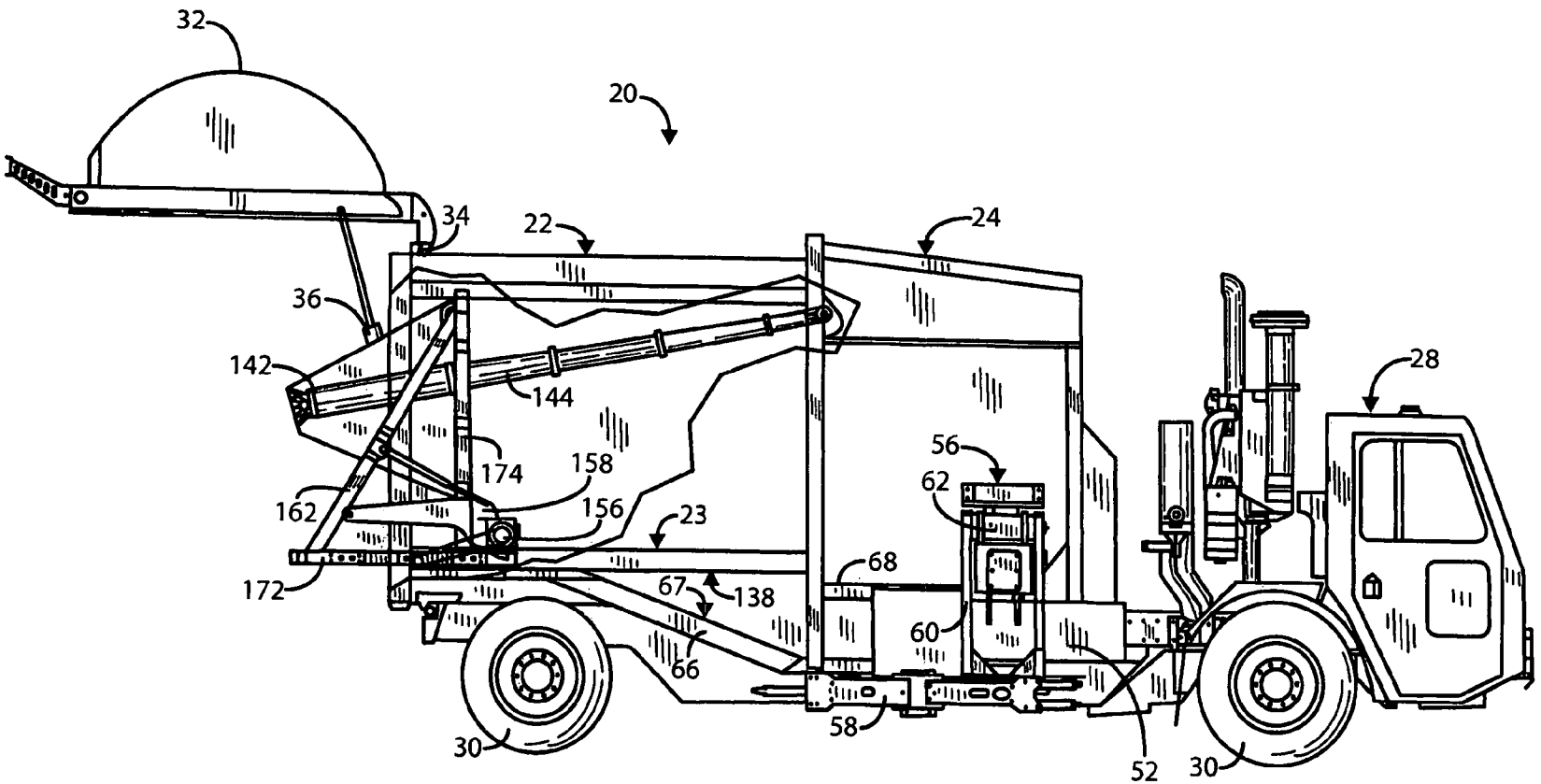
FIG. 14 is a view similar to FIG. 6 showing the alternative embodiment in a second full-eject stroke position with the packer-ejector assist panel fully rotated to scoop and remove material from the dropped area.
Figure 15:
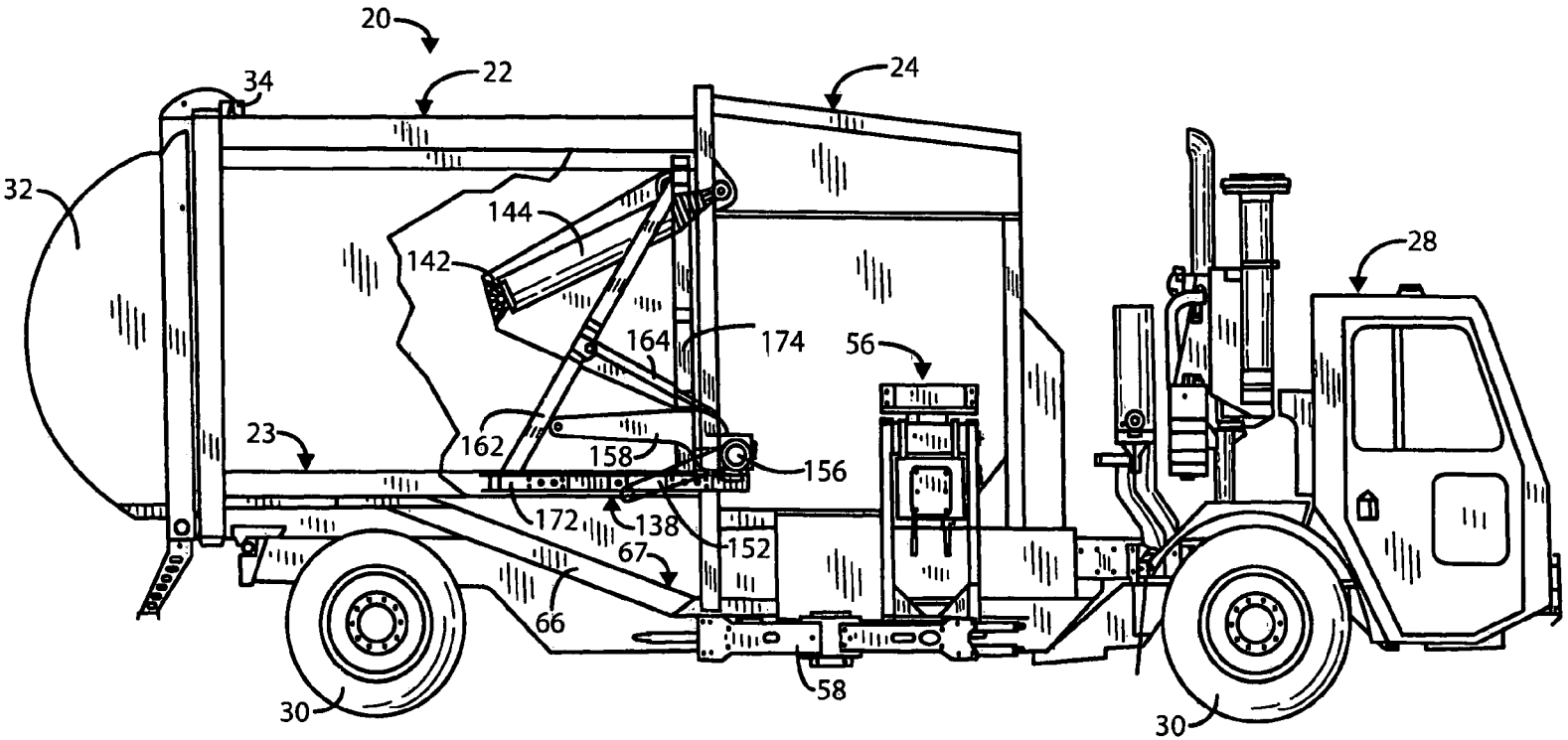
FIG. 15 is a view showing the ejection system in the retracted position after the ejection stroke of FIG. 14 with the tailgate closed.
Figure 16:
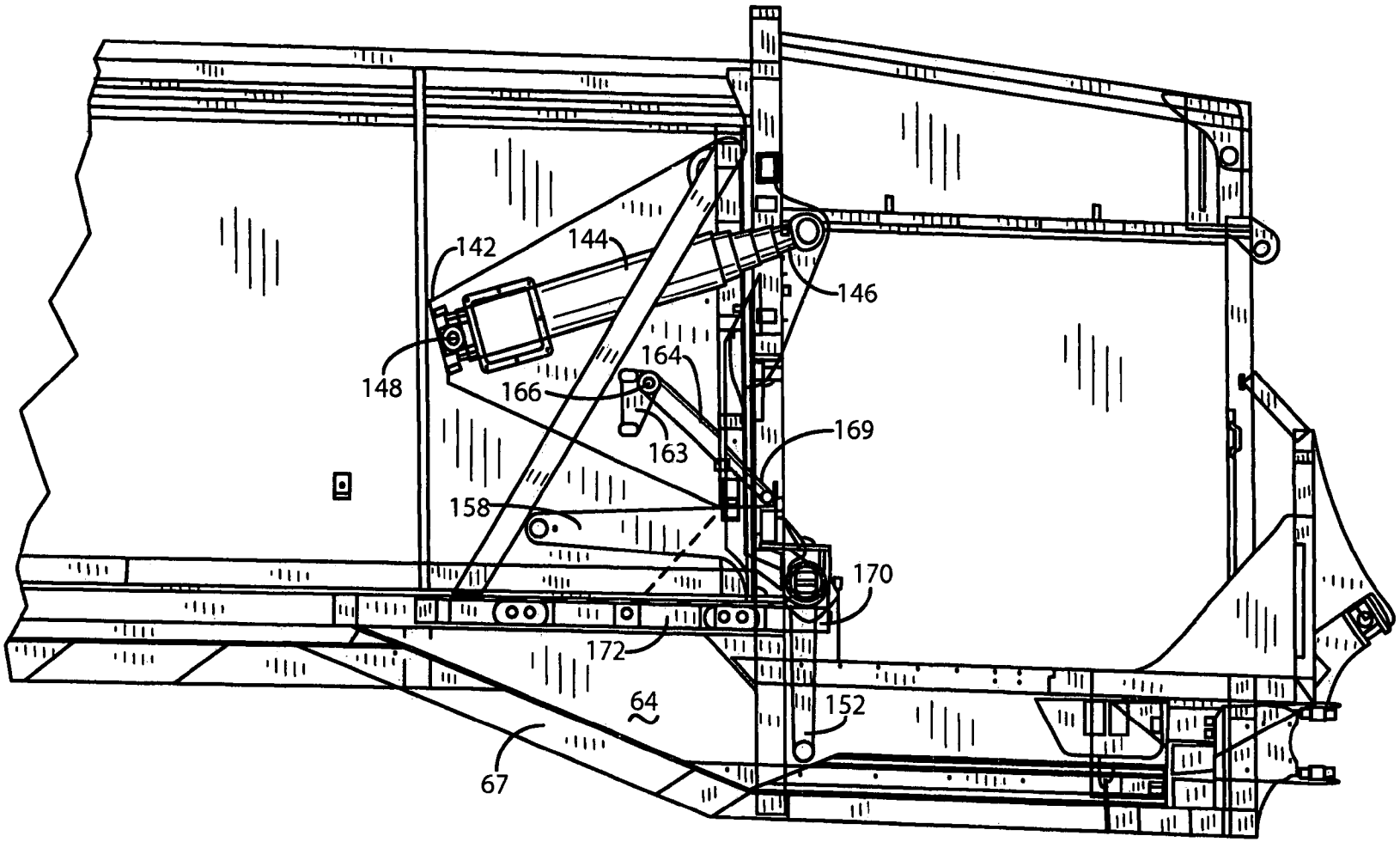
FIG. 16 is an enlarged fragmentary side elevational view of a truck body exposing internal parts and showing the ejector fully retracted and the packer-ejector assist panel rotated to its lowest position relative to the charging hopper floor.
Figure 17:
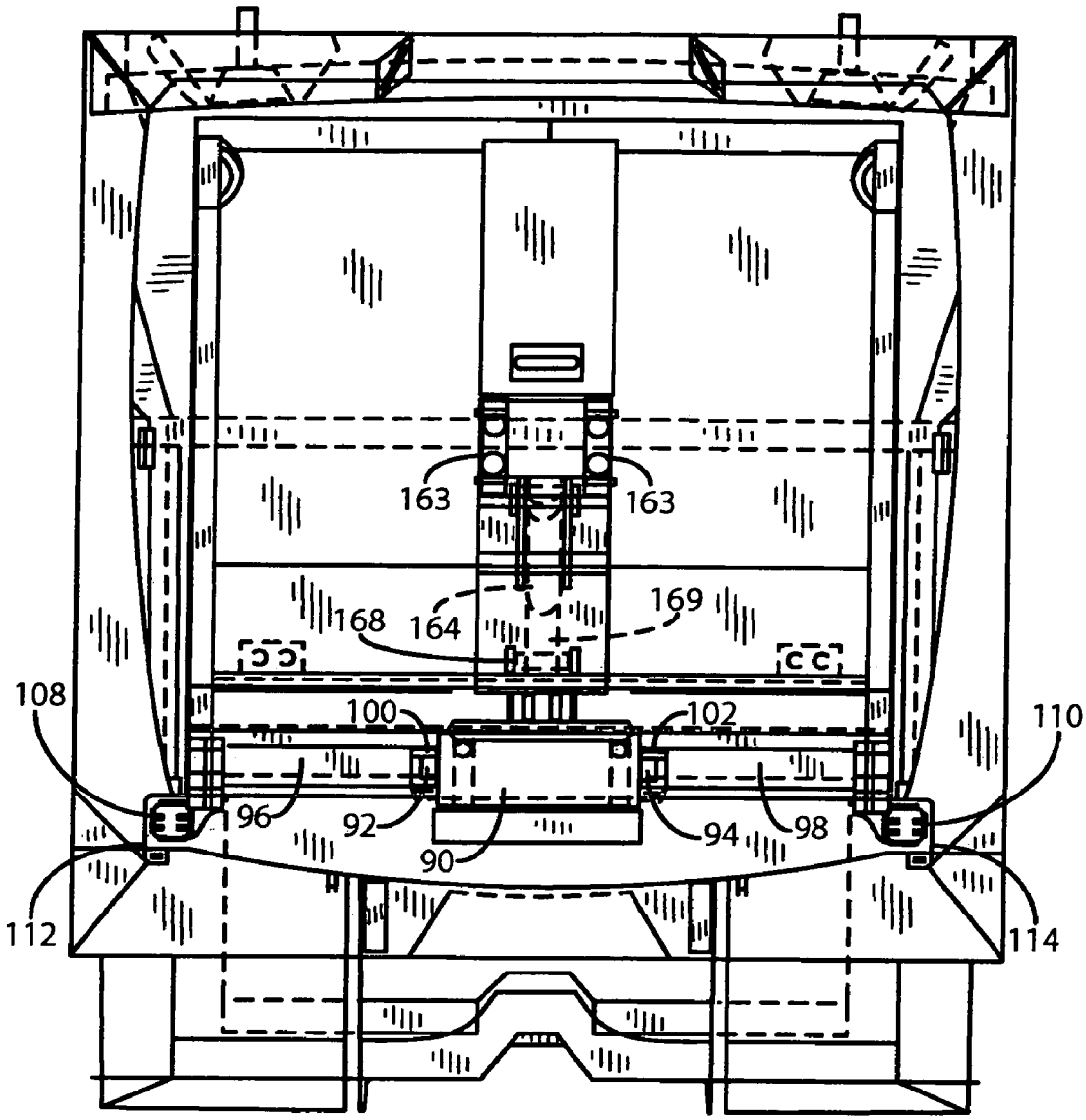
FIG. 17 is a front elevational view with some internal parts exposed taken from the charging hopper of the refuse storage enclosure in FIGS. 9-16 showing the mounting of the packer-ejector assist panel and linear ejector blade operator with the packer-ejector assist panel in the position shown in FIG. 16.
Figure 18:
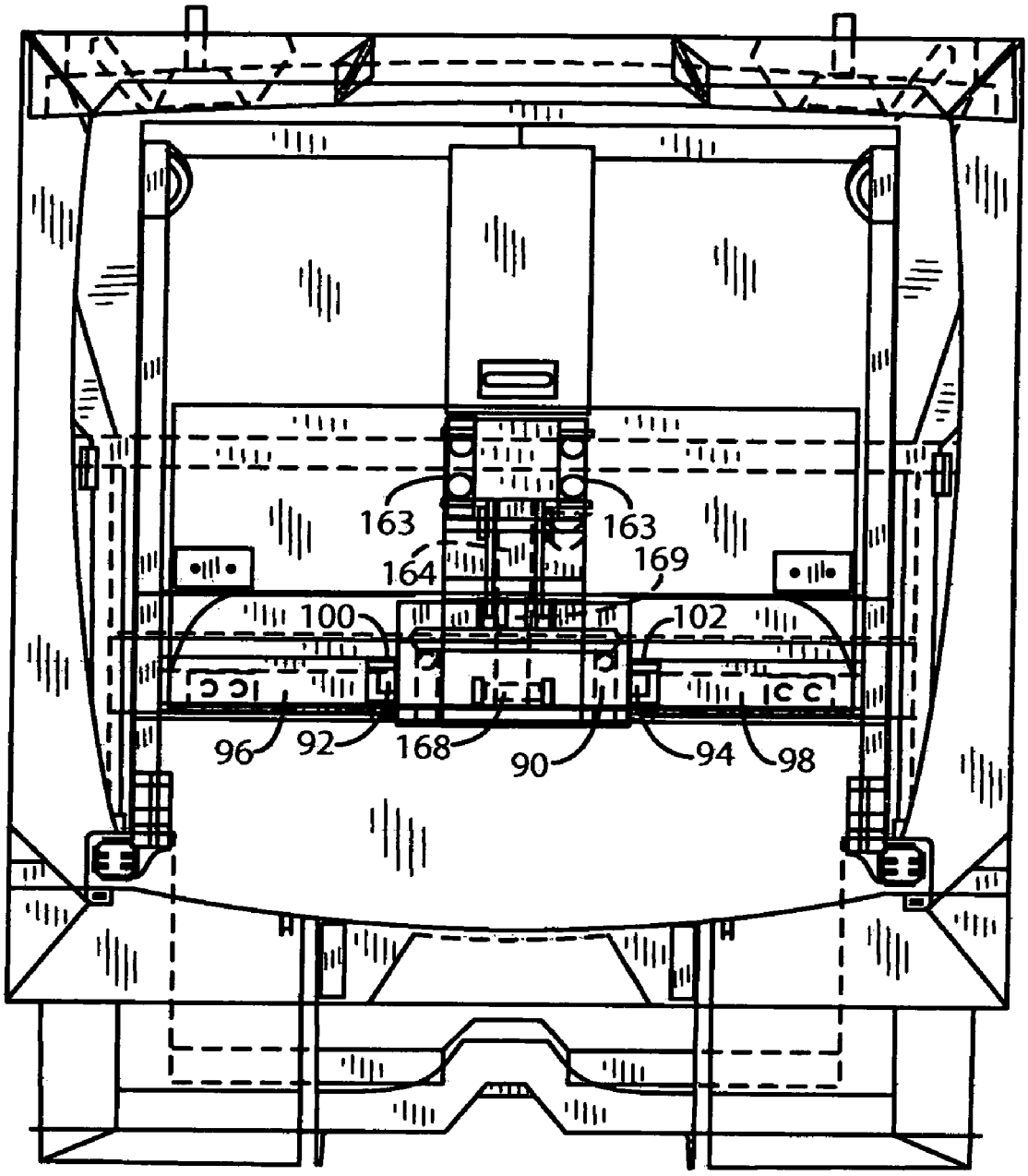
FIG. 18 is a view similar to FIG. 17 with the packer-ejector assist panel in the retracted and fully raised position as in FIG. 11.

A packer-ejector assist panel assembly mechanism is shown generally at 150 and includes a vertically rotating panel member 152 designed to be pivoted in the manner of the panel 46 of the previous embodiment utilizing a hydraulic rotary motor 154 connected to dual output shafts, one of which is shown at 156 which rotate the panel 152 through about 270° of rotation as seen in FIGS. 14 and 15. The panel member 152 is carried by a plurality of shaped support members as at 158 which, in turn, are pivotally mounted as at 160 from ejector panel structural support members as at 162. The packer-ejector assist panel 152 can be raised and lowered using a cylinder as at 164 pivotally attached between anchor members 163 (FIGS. 16-18) as at 166 and at 168 (FIGS. 17 and 18) so as to provide a lever arm at the outward portion of said pivoting support members 158, such that retraction and extension of the cylinder rod 169 of cylinder 164 readily pivots the support members 158 upward thereby raising or lowering the packer-ejector assist panel assembly as shown in FIGS. 11, 12 and 16. This enables the entire packer-ejector assist assembly to be moved away from the opening 138 when desired. The supports 158 and the packer-ejector assist panel assembly rest on an extension ledge 170, which is part of the structural base of the ejector mechanism that includes base members as at 172 when it is in the fully lowered position.

Other components of the side loading refuse vehicle are generally similar and may be substantially identical to those described with regard to the earlier embodiment and it is believed that description need not be repeated. The operating sequence of the system of the alternate embodiment differs from that previously described. FIG. 9 shows the side loading refuse vehicle with the packer ram 50 and the packer-ejector assist panel blade 152 in their fully retracted or stowed positions with the tailgate 32 closed and the ejector panel 140 in its fully retracted position ready to receive material into the charging hopper 24 which can be accomplished either by using the container handling system 56 or manually. Thus, the packing operation is very similar to that shown in the earlier embodiment with the packer-ejector assist panel 152 being optionally used to assist in the packing function.

Figure 10:
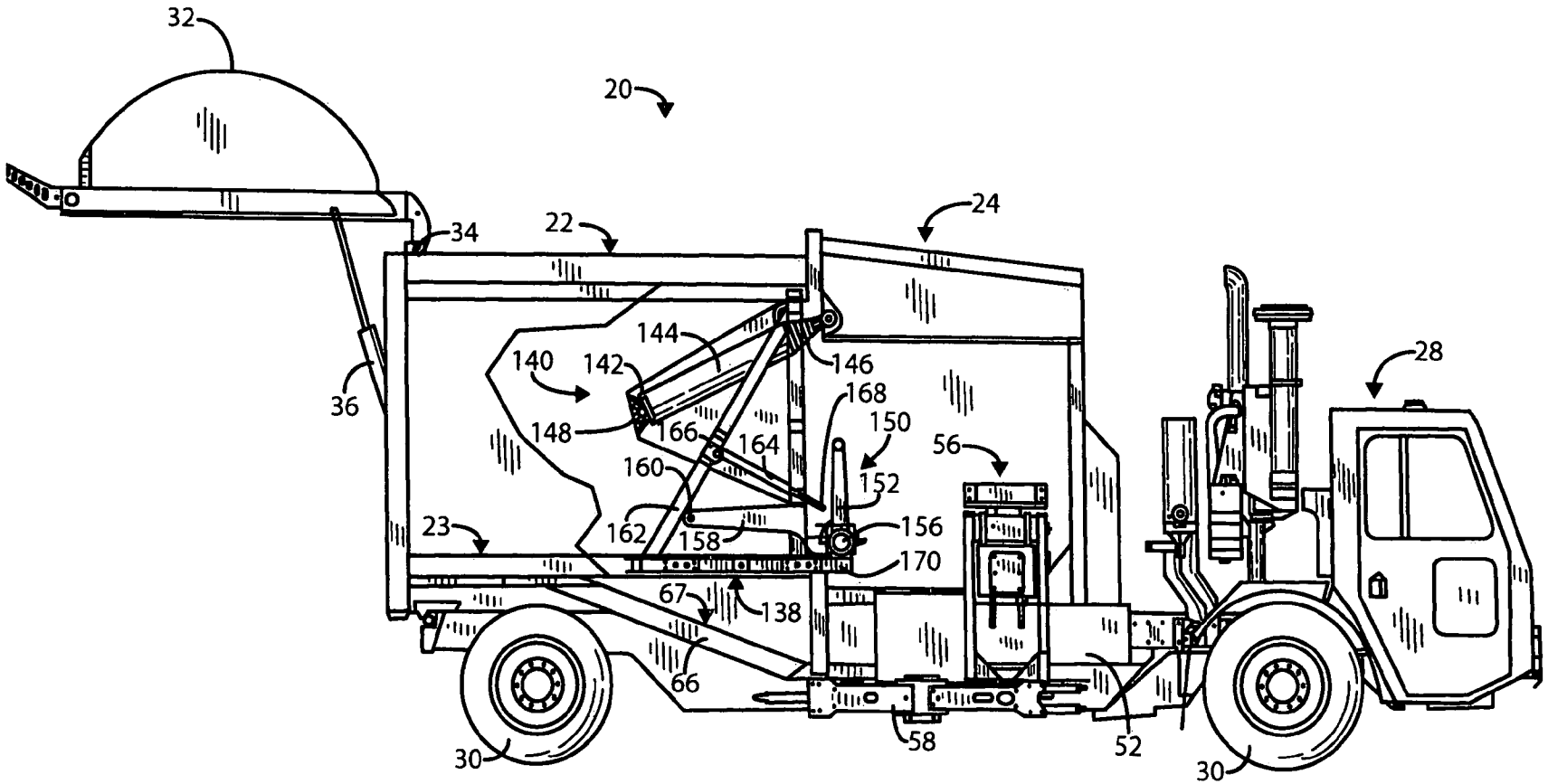
FIG. 10 is a view similar to FIG. 3 including the packer-ejector assist panel assembly embodiment of FIG. 9.

Steps in the ejection cycle utilizing the alternate embodiment packer-ejector assist panel assembly are depicted in FIGS. 10-15. In FIG. 10, the system is shown with the packing ram and the ejector carrying the packer-ejector assist panel 152 in the fully retracted or stowed positions with the packer-ejector assist panel itself in the fully lowered and rotated to the retracted or stowed position. The tailgate 32 has been unlatched and raised in preparation for the ejection operation, as is well known. In FIG. 11, the packer-ejector assist panel assembly is shown in the raised position so it will be out of the way during an initial ejection stroke in the sequence which is directed to ejecting material contained in the main storage enclosure volume 22. FIG. 12 depicts the ejector panel assembly 140 in its fully rearward or full eject position having pushed all the materials within the confines of the storage enclosure 22 out of the open tailgate. Note that the cylinder 144 is in its fully extended disposition. This initial stroke removes all the material within the confines of the storage enclosure 22. A minor amount of material remains in the dropped area 64.

Figure 13:
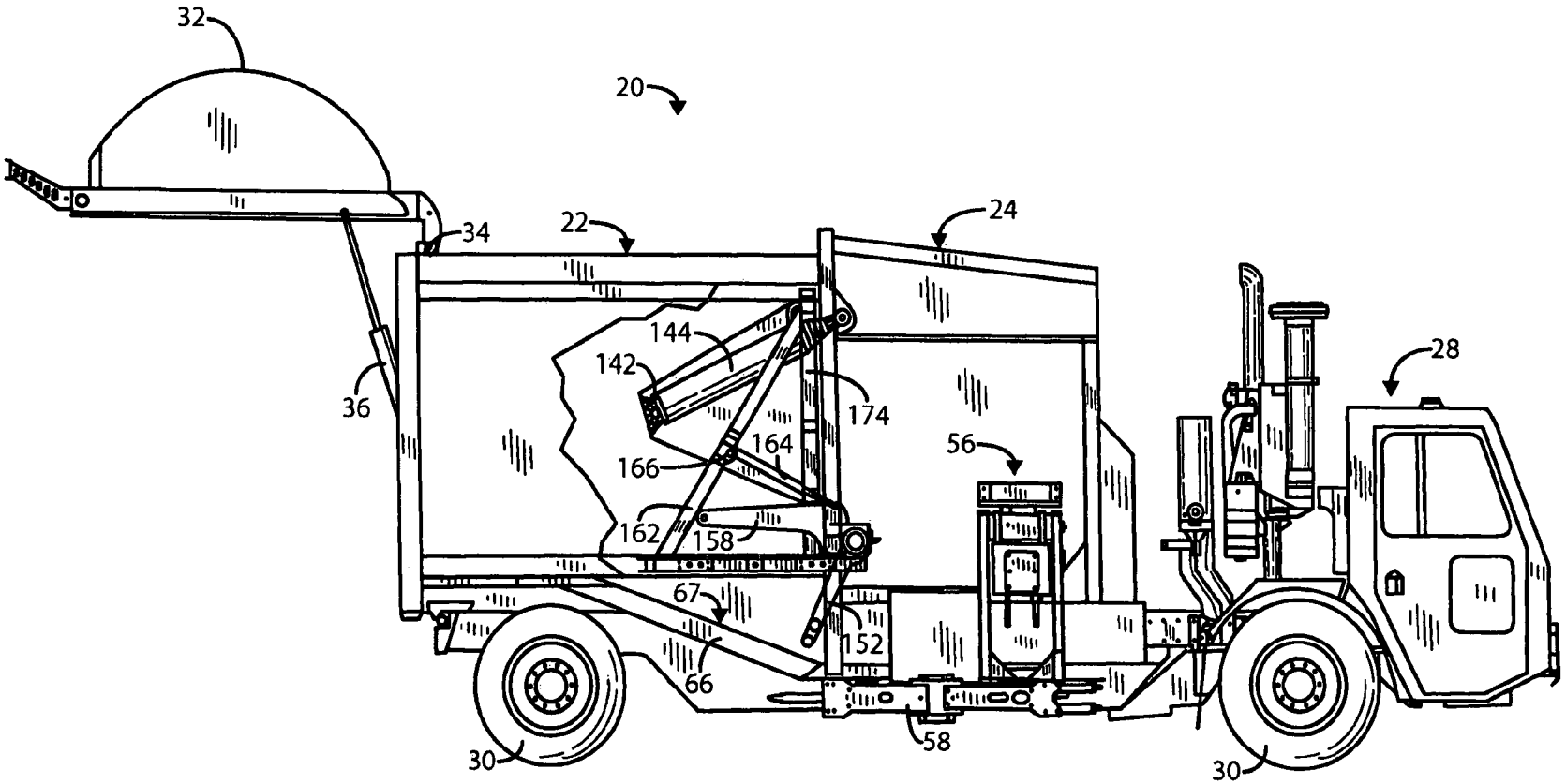
FIG. 13 is a view similar to FIG. 5 with the ejector fully retracted and the packer-ejector assist panel lowered and partially rotated to begin a dropped area sweep operation of an ejection sequence.

FIGS. 13-15 depict the second ejection sequence which is directed to removing the material which remains in the dropped area 64. Thus, in FIG. 13, the ejector system has been returned with fully forward or retracted position and the packer-ejector assist panel assembly has been lowered by extending the cylinder rod 169 of cylinder 164 and the packer-ejector assist panel 152 partially rotated so that it protrudes into the dropped area 64 substantially perpendicular to the sloped floor 67 of the dropped area 64 which is parallel to chassis structural member 66. In FIG. 14, the second full-eject stroke has been performed with the packer-ejector assist panel having been pivoted to its fully rotated position as the ejector system is moved rearward through the storage compartment 22. It should be noted that in this manner, the remainder of the material scooped by the packer panel 152 from the dropped area 64 is also ejected.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A side loading, refuse collection vehicle body for loading, compacting, transporting and ejecting refuse materials comprising:

(a) a hollow refuse storage enclosure for containing compacted refuse having a rear refuse discharge opening closed by a mechanized tailgate and a forward bottom refuse receiving opening;

(b) a charging hopper extending forward of and beneath said storage enclosure for receiving refuse, said charging hopper having a floor lower than that of said storage enclosure thereby creating a dropped area in communication with said refuse receiving opening of said storage enclosure;

(c) a packing mechanism in said charging hopper for moving refuse materials from in said charging hopper into said storage enclosure and packing said refuse materials in said storage enclosure;

(d) an ejection mechanism in said storage enclosure, said ejection mechanism comprising a transverse, generally vertical ejection panel selectively operable along a direction parallel to the length of said refuse storage enclosure to provide complete ejection of the contents thereof and a telescoping linear operator for reciprocally operating said panel during an ejection stroke; and (e) a panel mechanism including a transverse, generally vertically-pivoting packer-ejector assist panel member carried by a pivot mounting with a generally horizontal pivot reference and, wherein said panel member is carried by said ejection mechanism for selectively sweeping said dropped area and, wherein said panel mechanism further comprises a device for generally vertically displacing said pivot mounting of said packer-ejector assist panel relative to said ejection mechanism.

2. A refuse collection vehicle body as in claim 1 wherein said panel member, when lowered, selectively pivots to sweep said dropped area and selectively blocks a major portion of said refuse receiving opening during operation of said refuse ejection system to eject the contents of said dropped area.

3. A refuse collection vehicle body as in claim 1 further comprising a container handling mechanism associated with said charging hopper for emptying refuse containers.

4. A refuse collection vehicle body as in claim 1 wherein said telescoping linear operator is a telescoping hydraulic cylinder.

5. A refuse collection vehicle body as in claim 1 wherein said panel member is operated by a reciprocally rotating hydraulic motor rotating a mounting shaft.

6. A refuse collection vehicle body as in claim 5 wherein said panel member is mounted on a pair of aligned mounting shafts operated by a central dual-shaft hydraulic motor.

7. A refuse collection vehicle body as in claim 1 wherein said pivot mounting of said panel member comprises a pivot mount connected to said ejection mechanism and wherein said mechanism for raising and lowering said packer-ejector assist panel comprises a fluid operated cylinder connected to raise and lower said pivot mounts.

8. A refuse collection vehicle body as in claim 7 wherein said panel member is carried by a plurality of pivot mounts in a generally vertical direction.

9. A refuse collection vehicle body as in claim 1 wherein said packing mechanism further comprises a generally low profile reciprocating packing ram mechanism and includes an attached follower panel for preventing refuse from being deposited behind said packing mechanism.

10. A refuse collection vehicle body as in claim 3 wherein said container handling mechanism is mounted on a side of said charging hopper.

11. A refuse collection vehicle body as in claim 10 wherein said container handling mechanism is mounted in an offset arrangement to accommodate manual loading alongside.

12. A refuse vehicle including a vehicle body as in claim 1.

13. A refuse collection vehicle as in claim 12 further comprising a container handling mechanism mounted on said charging hopper for emptying refuse containers into said charging hopper.

14. A refuse collection vehicle body as in claim 2 wherein said vertically pivoting blade of said panel member pivots through an arc subtending an angle of about 270°.

15. A method of packing refuse and ejecting refuse in a packer body that includes a dropped body charging hopper that includes the steps of:

(a) providing a refuse collection vehicle as in claim 1;

(b) employing said vertically-pivoting packer-ejector assist panel to selectively sweep said charging hopper; and (c) selectively raising and lowering said pivot mounting of said panel between uses to more advantageously accommodate collection of certain types of refuse;

(d) wherein said pivot mounting when raised does not participate in packing or ejecting refuse thereby allowing the processing of larger items.

* * * * *